US006358427B1

(12) United States Patent
Smith et al.

(10) Patent No.: US 6,358,427 B1
(45) Date of Patent: Mar. 19, 2002

(54) MARKING DIAMOND

(75) Inventors: James Gordon Charters Smith, Buckinghamshire; Keith Barry Guy, Middlesex; Graham Ralph Powell, Buckinghamshire; Michael Peter Gaukroger, Hampshire, all of (GB)

(73) Assignee: Gersan Establishment, Liechtenstein (LI)

( * ) Notice: Subject to any disclaimer, the term of this patent is extended or adjusted under 35 U.S.C. 154(b) by 0 days.

(21) Appl. No.: 09/423,350

(22) PCT Filed: May 22, 1998

(86) PCT No.: PCT/GB98/01493

§ 371 Date: Feb. 9, 2000

§ 102(e) Date: Feb. 9, 2000

(87) PCT Pub. No.: WO98/52773

PCT Pub. Date: Nov. 26, 1998

(30) Foreign Application Priority Data

May 23, 1997 (GB) ..... 9710736
May 23, 1998 (GB) ..... 9710736

(51) Int. Cl.[7] ..... B44C 1/22

(52) U.S. Cl. ..... 216/28; 216/47; 216/65; 216/66; 216/67; 216/41; 63/32; 40/625; 40/629

(58) Field of Search ..... 216/28, 41, 47, 216/65, 66, 67; 63/32; 40/625, 629

(56) References Cited

U.S. PATENT DOCUMENTS

| | | | | |
|---|---|---|---|---|
| 4,018,938 | A | 4/1977 | Feder et al. | 427/43 |
| 4,117,301 | A | 9/1978 | Goel et al. | 219/121 |
| 4,219,199 | A | 8/1980 | Okuda | 274/38 |
| 4,425,769 | A | 1/1984 | Hakoune | 63/32 |
| 4,632,898 | A | 12/1986 | Fister et al. | 430/313 |
| 4,675,273 | A | 6/1987 | Woods et al. | 430/325 |
| 4,756,794 | A | 7/1988 | Yoder | 156/643 |
| 4,780,177 | A | 10/1988 | Wojnarowski et al. | 156/643 |
| 4,786,358 | A | 11/1988 | Yamazaki et al. | 156/643 |
| 4,842,677 | A | 6/1989 | Wojnarowski et al. | 156/643 |
| 4,863,557 | A | 9/1989 | Kokakau et al. | 156/643 |
| 5,045,150 | A | 9/1991 | Cleeves et al. | 156/643 |
| 5,137,799 | A | 8/1992 | Kaempf et al. | 430/270 |
| 5,160,405 | A | 11/1992 | Miyauchi et al. | 156/643 |
| 5,196,376 | A | 3/1993 | Reche | 437/225 |
| 5,269,890 | A | 12/1993 | Marchywka | 204/146 |
| 5,344,526 | A | 9/1994 | Nishibayashi et al. | 156/643 |
| 5,397,428 | A | 3/1995 | Stoner et al. | 117/86 |
| 5,458,733 | A | 10/1995 | Tessmer et al. | 216/67 |
| 5,538,820 | A | 7/1996 | Fisher | 430/18 |
| 5,591,480 | A | 1/1997 | Weisman et al. | 216/13 |

FOREIGN PATENT DOCUMENTS

| | | |
|---|---|---|
| EP | 449439 | 10/1991 |
| GB | 1546503 | 5/1979 |
| GB | 1591992 | 7/1981 |
| JP | 63-034927 | 2/1988 |
| JP | 63-220524 | 9/1988 |
| JP | 63-220525 | 9/1988 |
| JP | 63-237531 | 10/1988 |
| JP | 08-048597 | 2/1996 |
| WO | 97/03846 | 2/1997 |

*Primary Examiner*—Randy Gulakowski
*Assistant Examiner*—Michael Kornakov
(74) *Attorney, Agent, or Firm*—Cesari and McKenna, LLP

(57) ABSTRACT

An invisible information mark is provided on a facet of a diamond gemstone by applying a plasma resist to the exposed surface of the gemstone, applying an electrically conducting layer of metal to the region where the information mark is to be formed, ablating a selected zone of the metal and resist layers by ultraviolet laser thus forming a mask on the surface of the facet, electrically connecting the metal layer and plasma etching the facet through the mask, thus forming a mark of appropriate depth on the surface of the gemstone.

17 Claims, No Drawings

MARKING DIAMOND

BACKGROUND OF THE INVENTION

The present invention relates to a method of marking a surface of a diamond to produce a mark which is invisible to the naked eye. The mark may be any mark, but the invention is particularly though not exclusively directed to plying a information mark to the diamond. The diamond may be for instance an industrial diamond such as a wire-drawing die, though the invention is of particular interest in marking gemstone diamonds, for instance for applying a mark which is invisible to the naked eye or invisible to the eye using a ×10 loupe, when the mark can be applied to a polished facet of the gemstone without detracting from its clarity or colour grade. When a loupe is used, the visibility is assessed under the internationally accepted conditions for clarity grading, i.e. using a 10× magnifying achromatic, aplanatic loupe under normal light, this being a white diffuse light, not a spot light. The marks can be used to uniquely identify the gemstone by a serial number or as a brand or quality mark. In general, the mark should be capable of being viewed under suitable magnification and viewing conditions, and, if applied to a gemstone, should not detract from the value or appearance of the stone and should preferably not exhibit blackening.

U.S. Pat. No. 4 425 769 discloses marking the surface of a gemstone by depositing a photoresist resin on the surface of the gemstone, applying a photographic film to the photoresist layer, exposing the photoresist through the photographic film, developing the photoresist by etching, and then etching the surface of the gemstone by cathode bombardment with an ionised gas in a vacuum chamber. The marks applied are generally of rather poor resolution and the application of the mars takes a significant amount of time.

There is a detailed description of the nature of the marks that can be applied in W097/03846, in which the marks are applied by irradiating a diamond gemstone with ultraviolet laser radiation using a projection mask.

It is generally desirable to produce marks of improved resolution and to reduce the time required to apply the marks so that for instance serial numbers can be applied using an assembly or sequence of masks.

THE INVENTION

According to the invention, a layer of resist is applied to the surface of the diamond, a selected zone of the resist layer is ablated to form a mask on the diamond surface, and the diamond surface is etched through the mask, wherein an electrically-conducting layer is applied to the resist layer, and an electrical connection is provided to the electrically-conducting layer to prevent charging during etching. The invention extends to a diamond whose surface has been marked by the method, and to apparatus for carrying out the method.

The preferred form of etching is plasma etching. For plasma etching, it is especially advantageous to have an electrically-conducting layer, for example metal, and provide an electrical connection to the layer, to prevent charging of the diamond, the resist can then be non-electrically-conducting. The layer of metal can for instance be a layer of gold, for instance about 0.1 microns thick. It need not be applied to the whole of the resist layer, only to a region sufficiently large to prevent charging during plasma etching. The bilayer mask so formed may require different ablation conditions to a single layer, but generally both layers are ablated substantially simultaneously. It is found that the electrically-conducting layer effectively remains on the resist around the ablated zone, and thus prevents charging during plasma etching, whilst leaving the ablated zone clear of metal. The metal should have an ablation threshold no higher than that of the resist. A metal such as gold cannot be used on its awn as a resist because it does not give high enough resolution, ablating too readily and leaving poorly defined edges. Furthermore, if a thicker layer of metal such as gold is used, there is a risk of the metal sputtering and redepositing in the ablated zone.

A completely dry technique can be used (with no chemical etching or stripping steps); although wet cleaning may be required after plasma etching in order to remove the mask, this is not a critical step requiring controlled conditions. The bilayer mask can provide greatly improved resolution (particularly in relation to the laser etching technique disclosed in W097/03846), and, in comparison with W097/03846, requires a reduced pulse count if laser ablation is employed, for instance using about 20 pulses or fewer, say 10 pulses, rather than 500 pulses, making it practical to produce serial numbers using a sequence of masks, one for each number, for the resist ablation step. The ablation could be performed using a mask projection technique, but can be performed by direct beam writing.

The resist can be any suitable resist, for instance a plastics (polymer) resist. The thickness of the resist layer may for instance be not less than about 0.5 micron and/or not more than about 1 micron.

In general, it is preferred that the plasma etching should be to a depth of not less than about 10 nm and/or not greater than about 70 nm, more preferably not less than about 20 nm and/or not treater than about 50 nm, a suitable value being about 30 nm.

As an alternative to plasma etching, the diamond exposed by the mask can be etched using a broad ion beam to convert it to graphite or other non-diamond carbon which may then be removed by, for example, acid cleaning.

The invention is particularly useful in association with etching methods which produce charging.

EXAMPLE

A diamond gemstone is mounted on a holder (or a plurality of diamond gemstones can be so mounted). A layer of non-conducting polymer plasma etch resist is applied to the exposed surface of the diamond, for instance by spin coating using e.g. a Novalac photoresist or by evaporation. The resist layer is 0.5 to 1 microns thick.

A layer of gold about 0.1 microns thick is deposited on the resist layer on at least part of the facet to be marked.

The resist and gold layers are patterned by laser ablation with about 10 pulses to leave a clean diamond surface. The laser wavelength is selected to give the best results with the chosen resist shorter wavelengths permitting greater resolution than longer ones. 248 nm or other wavelengths may be used, but the preferred wavelength is 193 nm.

Using the holder, an electrical connection is made to the metal layer and the diamond is plasma etched in a standard manner, preferably under a partial pressure of oxygen. Zones of the facet not protected by the resist are etched to a depth of about 30 nm, providing a clean etch with no evidence of blackening. The electrical connection to the metal layer prevents charging.

The stone or stones is/are removed from the holder. The mask is removed by wet cleanings.

The apparatus used for the laser ablation can be similar to that shown in FIG. 2 of WO 97/03846.

The present invention has been described above purely by way of example, and modifications can be made within the invention.

We claim:

1. A method of marking a diamond gemstone having a polished facet to produce an information mark on the polished facet which is invisible to the eye using a x10 loupe, the method comprising:

applying to said facet a layer of resist;

applying an electrically-conducting layer to said resist layer;

ablating a selected zone of the electrically conducting layer and of the resist layer to form a mask on said facet;

providing an electrical connection to said electrically conducting layer; and etching said facet through said mask using a plasma or a broad ion beam in order to mark said facet;

whereby the electrical connection to the electrically-conducting layer prevents charging during the etching.

2. The method of claim 1, wherein the resist is non-electrically-conducting.

3. A method of marking a surface of a diamond to produce an information mark thereon which is invisible to the naked eye, the method comprising:

applying to said surface a layer of resist;

applying an electrically-conducting layer to said resist layer;

ablating a selected zone of the electrically conducting layer and of the resist layer to form a mask on the diamond surface;

providing an electrical connection to the electrically conducting layer; and etching the diamond surface through the mask by an etching method that tends to produce charging, to thereby mark the diamond surface;

whereby the electrical connection to the electrically conducting layer prevents charging during said etching.

4. The method of claim 3, wherein the thickness of the resist layer is about 0.5 to 1 microns.

5. The method of claim 3, wherein the electrically conducting layer is metal.

6. The method of claim 3, wherein the resist layer is non-electrically conducting.

7. The method of claim 3, wherein the thickness of the electrically conducting layer is about 0.1 microns.

8. The method of claim 3, wherein the selected zone of the layer is ablated using laser ablation.

9. The method of claim 8, wherein about 20 pulses or fewer are used for the laser ablation.

10. The method of claim 3, wherein the diamond surface is etched to a depth of about 15 to about 70 nm.

11. The method of claim 3, wherein the diamond surface is etched to a depth of about 20 to about 50nm.

12. The method of claim 3, wherein the diamond surface is etched by plasma etching.

13. The method of claim 3, wherein the diamond surface is etched using a broad ion beam.

14. The method of claim 3, wherein the mark applied is invisible to the eye using a ×10 loupe.

15. The method of claim 3, wherein the diamond is a gemstone.

16. The method of claim 15, wherein the mark is applied to a polished facet of the gemstone.

17. A diamond having a surface on which is a mark invisible to the naked eye and which has been applied using the method of claim 3.

* * * * *